US005611502A

United States Patent [19]

Edlin et al.

[11] Patent Number: 5,611,502

[45] Date of Patent: Mar. 18, 1997

[54] INTERCEPTOR SEEKER/DISCRIMINATOR USING INFRARED/GAMMA SENSOR FUSION

[75] Inventors: George R. Edlin, Huntsville; J. Michael Madewell, Madison; Randy D. Buff, Huntsville; W. Welman Gebhart, Decatur, all of Ala.

[73] Assignee: The United States of America as represented by the Secretary of the Army, Washington, D.C.

[21] Appl. No.: 548,400

[22] Filed: Oct. 23, 1995

[51] Int. Cl.[6] ..... F41H 11/00; F42B 15/00; H01S 1/00

[52] U.S. Cl. ..... 244/3.16; 89/1.11; 244/3.15; 250/251

[58] Field of Search ..... 244/3.15, 3.16; 89/1.11; 250/251

[56] References Cited

U.S. PATENT DOCUMENTS

| | | | |
|---|---|---|---|
| 3,123,714 | 3/1964 | Chope | 250/251 |
| 4,429,411 | 1/1984 | Smither | 378/84 |
| 4,817,495 | 4/1989 | Drobot | 89/1.11 |
| 5,053,622 | 10/1991 | Kessler | 250/358.1 |
| 5,099,128 | 3/1992 | Stettner | 250/370.11 |
| 5,111,038 | 5/1992 | Taylor et al. | 250/225 |

OTHER PUBLICATIONS

R. K. Smither, "New Method for Focusing X Rays and Gamma Rays" Rev. Sci. Instrum. 53(2), Feb. 1982, pp. 131–141.

R. K. Smither, "Gamma–Ray and X–Ray Telescope Using Variable–Metric Diffraction Crystals", Corporate Source: Argonne Natl. Lab./Argonne Illinois/60439; Journal: Annals of the New York Academy of Sciences, 1984, V422, Mar., p. 384.

*Primary Examiner*—J. Woodrow Eldred
*Assistant Examiner*—Theresa M. Wesson
*Attorney, Agent, or Firm*—Freddie M. Bush; Hugh P. Nicholson

[57] ABSTRACT

The disclosed innovative, interceptor seeker discriminator system has the capability to home in on targets containing nuclear materials by detecting the gamma fissions. The gamma signatures can be obtained from activating the nuclear material by a Neutral Particle Beam Weapon, or by detecting the natural fission emissions of the warhead. This system is innovative, in that the following properties are identified: 1) This system uses interactive discrimination techniques, which allows the gamma seeker to accurately home in on a true RV by comparing the return gamma emissions of objects. In this manner, the gamma seeker discriminator is expected to obtain substantially better discrimination K factor performance, when compared to using only IR techniques. 2) This system uses an interceptor/seeker to perform interactive discrimination and gamma sensors in conjunction with infrared sensors on the same interceptor platform (i.e., sensor fusion). A significant enhancement in interceptor performance is expected-by incorporating these methods. 3) This system is ideal for applications involving point defense for Conus Global Positioning Against Limited Strikes (GPALS) threat scenarios, and Nuclear Theater Missile Defense (TMD) threats.

6 Claims, 7 Drawing Sheets

AQUIRE → SCAN

HOMING ← HANDOVER AND TRACKING

INTERCEPTOR SEEKER/DISCRIMINATOR USING INFRARED/GAMMA SENSOR FUSION

DEDICATORY CLAUSE

The invention described herein may be manufactured, used, and licensed by or for the Government for Governmental purposes without the payment to us of any royalties thereon.

BACKGROUND OF THE INVENTION

The current Strategic Defense Initiative (SDI) architecture depends on ground based Interceptors and space based Brilliant Pebbles (PB). Since only a limited number of these systems are available for early deployment, the addition of large mumbers of credible decoys could quickly erode the ability of these systems to accomplish their missions. Therefore, it is necessary to provide a system having the capability to discriminate the decoys from the real Reentry Vehicles (RV's). Since passive and active sensors have difficulties discriminating decoys from RV's with decoys whose weights are just a few percent of the RV's, the value of an interactive system is recognized as will be apparent from the disclosures presented hereinbelow following additional background information. The present ground based and space based interceptor technologies are grouped into two basic categories, endo- or exoatmospheric weapons. The endoatmospheric vehicles depend on the ability of a passive infrared system operating within the Earth's atmosphere to provide the vehicle with adequate signal to noise in order to perform the homing and intercept of the incoming warhead. This system suffers from extensive IR seeker cooling requirements, and thus the performance will be degraded unless advanced cooling methods are developed. The exoatmospheric interceptors use IR sensors operating outside of the Earth's atmosphere which see much lower space noise backgrounds, and thus are expected to be more effective. However, while it has been demonstrated that exoatmospheric sensors can home in on and destroy moving targets in the presence of "crude penaids", it is still questionable whether passive IR sensors can discriminate threats that contain credible decoys (i.e., weights of a few percent, same size and shape, reflectivity, etc. of RV's). The use of gamma-rays have been considered for use in favorable signature applications. In the past, however, gamma-rays have not proven to be a favorable signature for most interactive discrimination applications because highly directional gamma sensors (which are needed to function in nuclear backgrounds) were not available, and the signal obtainable by conventional gamma detectors was felt by many to be too low. However, conceptual studies have determined that a very directional (to eliminate the nuclear background), highly efficient (to increase signal-to-noise) gamma-ray sensor can provide adequate signal to noise at distances of many kilometers. The gamma sensor of this type would provide the interceptor with a very accurate means of detecting RVs from decoys, because the decoys will not contain nuclear materials. IR sensors typically have discrimination K factors of around 3, while a gamma seeker discriminator is expected to have K factors of better than 5. In addition, the gamma sensor will not degrade in the stressing atmospheric heating environment of the endoatmospheric interceptor, as would an IR sensor.

The main objective of this invention is to provide a ground based (or space based) kinetic energy kill weapon equipped with a gamma-ray homing sensor/seeker that has the capability to accurately discriminate an RV from a decoy by detecting fission gammas emanating from the warhead contained within the RV.

A further object of this invention is to provide Variable Metric (V-M) transmission sensors/seekers for interceptors which are designed to utilize gamma-ray homing and Interactive Discrimination (ID) techniques.

The overall objectives of this invention are essential to meeting threats, and it is believed that the disclosed system would perform very efficiently in both the Theater Missile Defense (TMD) and Conus Global Positioning Against Limited Strike (GPALS) defense missions.

SUMMARY OF THE INVENTION

The gamma-ray homing sensor/seeker technique of this invention employs a combination of devices which are effective at short distances and longer distances. The method of the system is accomplished at short distances of about 5 to 10 kilometers without the use of any activation methods. At longer ranges of more than 100 Km, an activation method (such as a Neutral Particle Beam Weapon) must be used in conjunction with the gamma seeker discriminator, in order to obtain the gamma signal required by the gamma sensor. The gamma sensor will be aided by a conventional infrared sensor, in order to assure that the interceptor detects the targets at large distances, and to perform the tracking of the target after the gamma seeker discriminator has identified a RV. In other words, the IR sensor will perform the tracking, while the gamma seeker discriminator will perform the discrimination function. The gamma seeker discriminator also provides the interceptor with a means of performing sensor fusion of the gamma signatures with the infrared data, which should further enhance performance. The means for collecting gamma radiation over a large area and focusing the radiation onto a relatively small detector includes the use of a key element which is a large crystal diffraction lens. This lens uses "Variable-Metric" (V-M) crystals. The V-M lens is obtained by either creating a thermal gradient across the lens, or by changing the chemical composition of the lens in order to obtain the change in lattice spacing, which results in greater focusing capability.

DESCRIPTION OF THE PREFERRED EMBODIMENT(S)

Figure 1:
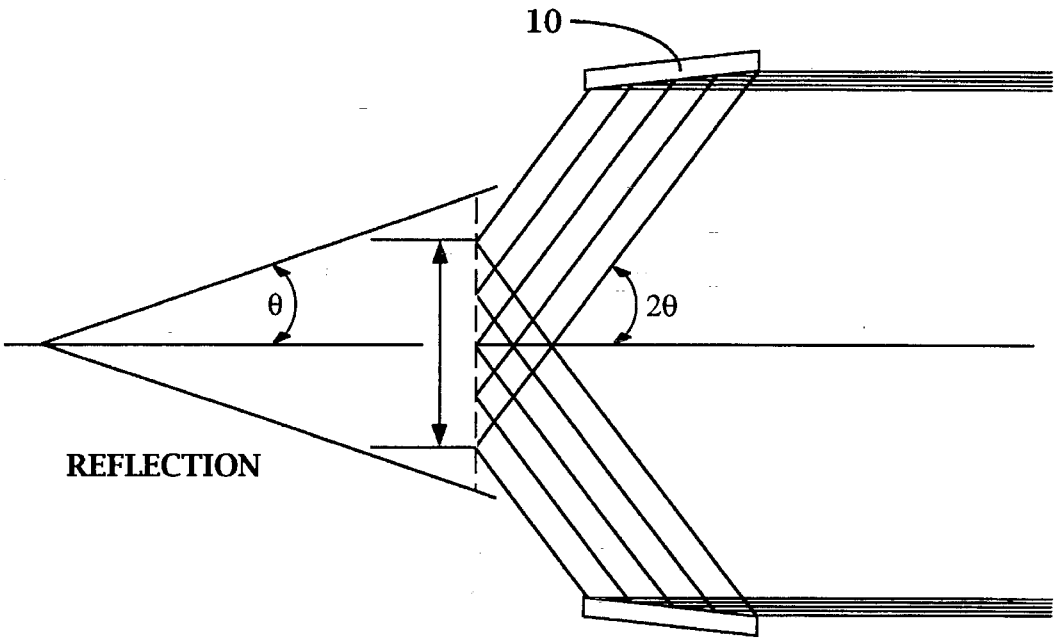
FIG. 1 is a schematic drawing of a prior art condenser type crystal lens 10 that uses only flat normal crystals to collect the radiation by reflection technique onto a small focal spot.
Figure 2:
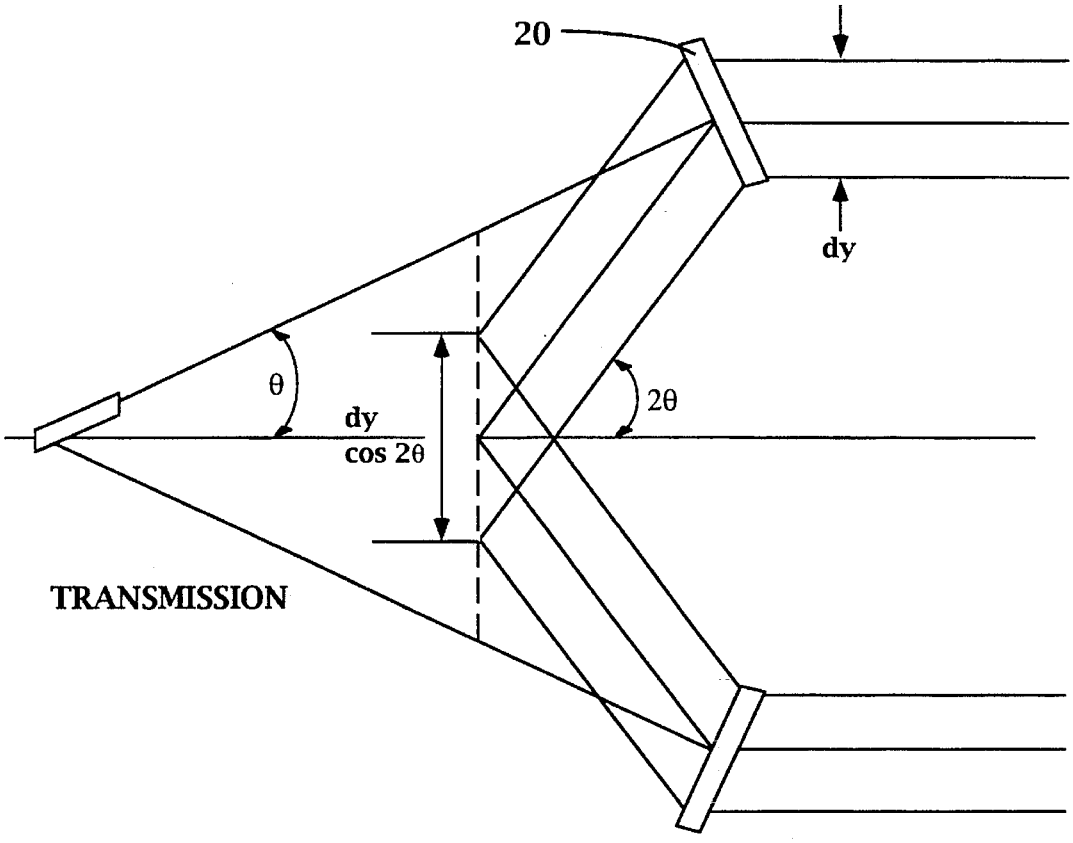
FIG. 2 is a schematic drawing of a prior art condenser type crystal lens 20 that uses only flat normal crystals to collect the radiation by transmission technique onto a small focal spot.
Figure 3:
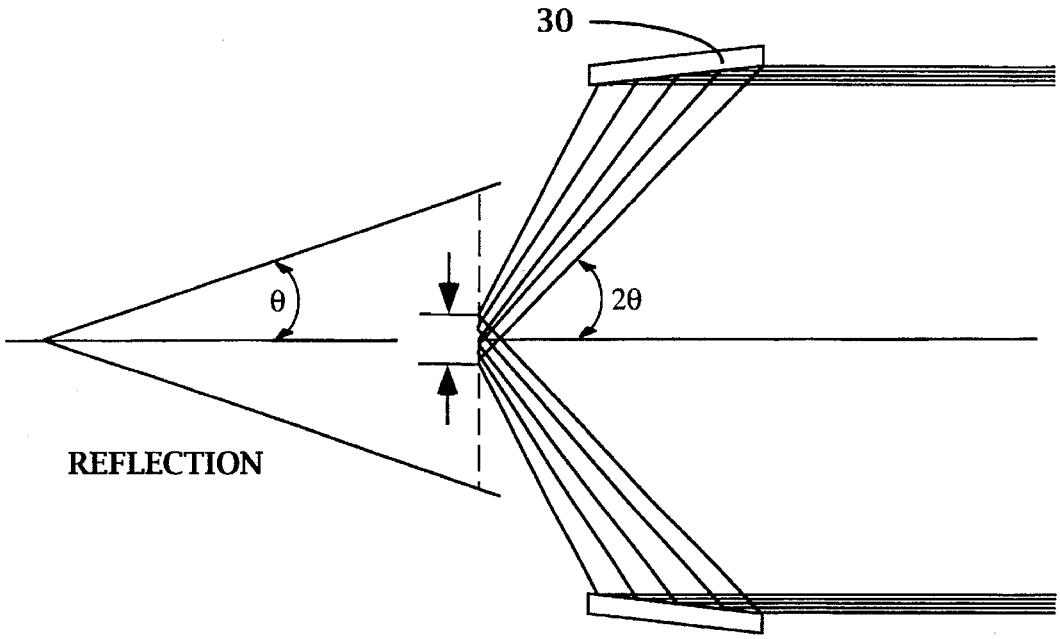
FIG. 3 is a schematic drawing of a true focusing type lens 30 that uses bent, V-M crystals to collect the radiation by reflection technique onto a very small focal point.
Figure 4:
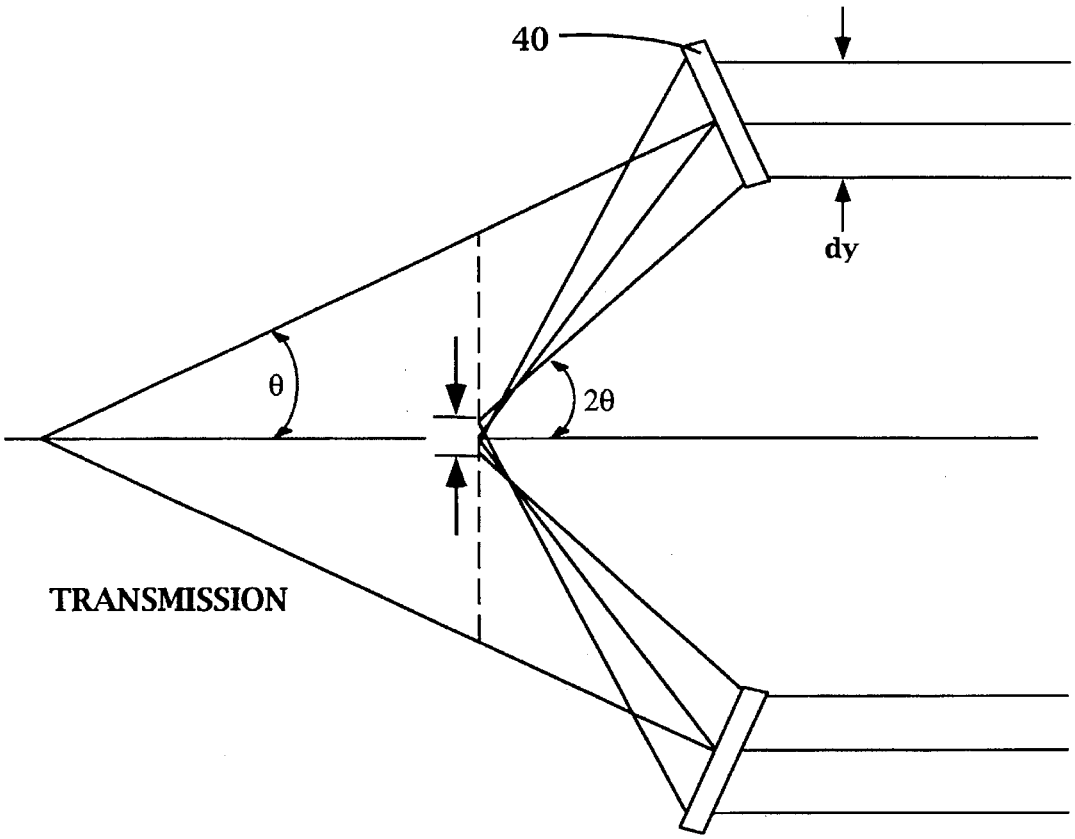
FIG. 4 is a schematic drawing of a true focusing type lens 40 that uses bent, V-M crystals to collect the radiation by transmission technique onto a very small focal point.
Figure 5:
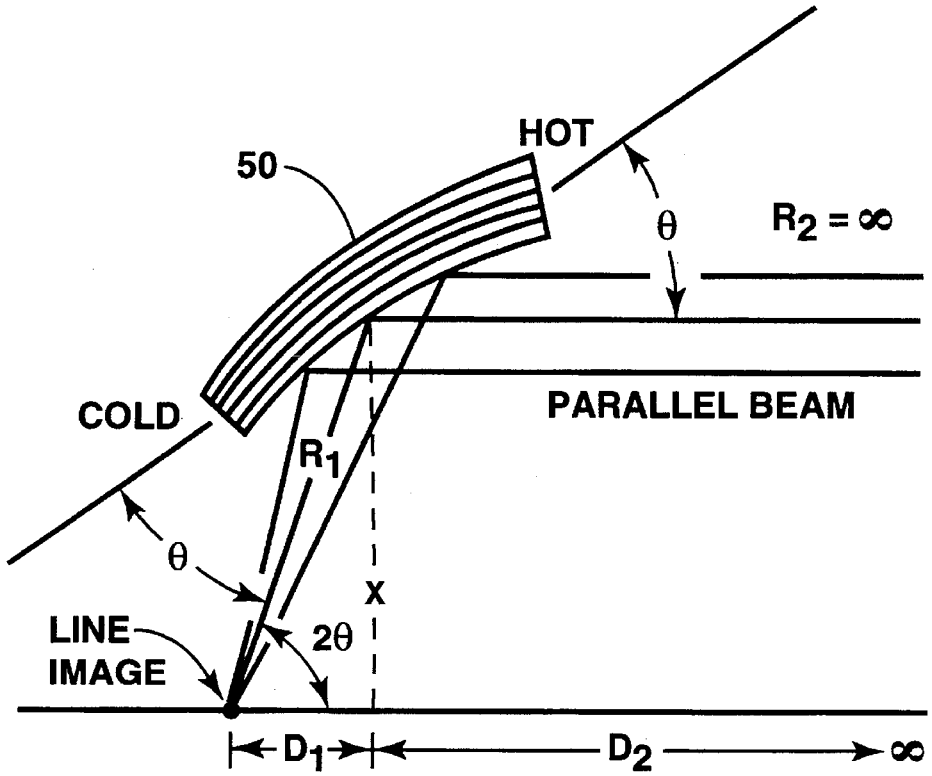
FIG. 5 is a schematic drawing of the Variable-Metric (V-M) lens 50 using a thermal gradient to obtain variation in the crystal lattice spacing to collect radiation by reflection technique onto a very small focal spot.
Figure 6:
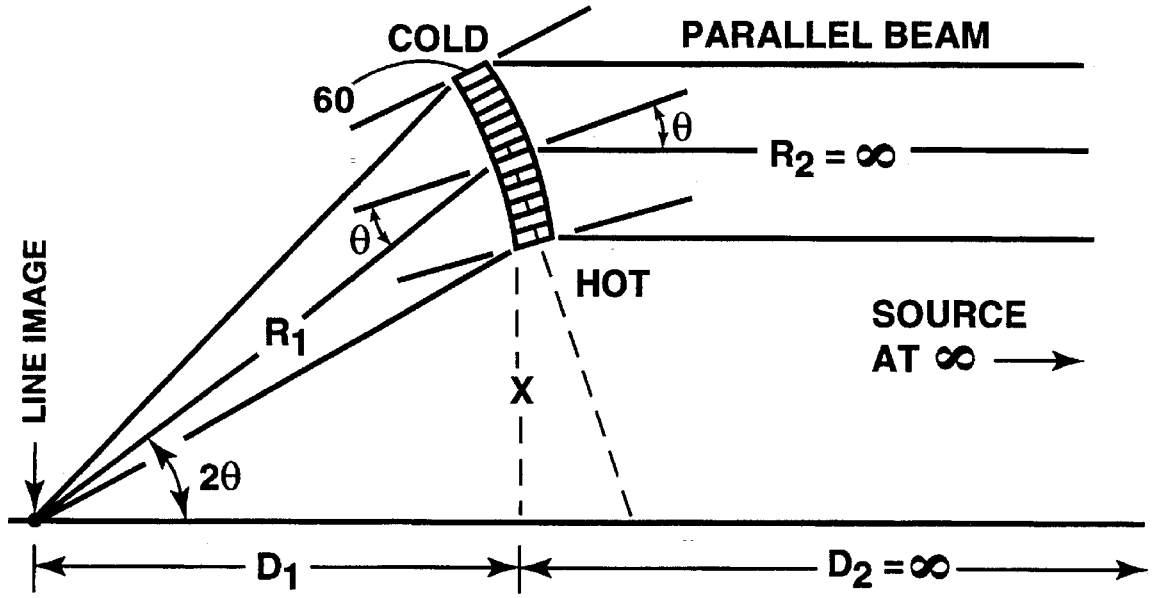
FIG. 6 is a schematic drawing of the Variable-Metric (V-M) lens 60 using a thermal gradient to obtain variation in the crystal lattice spacing to collect radiation by transmission technique onto a very small focal spot.
Figure 7:
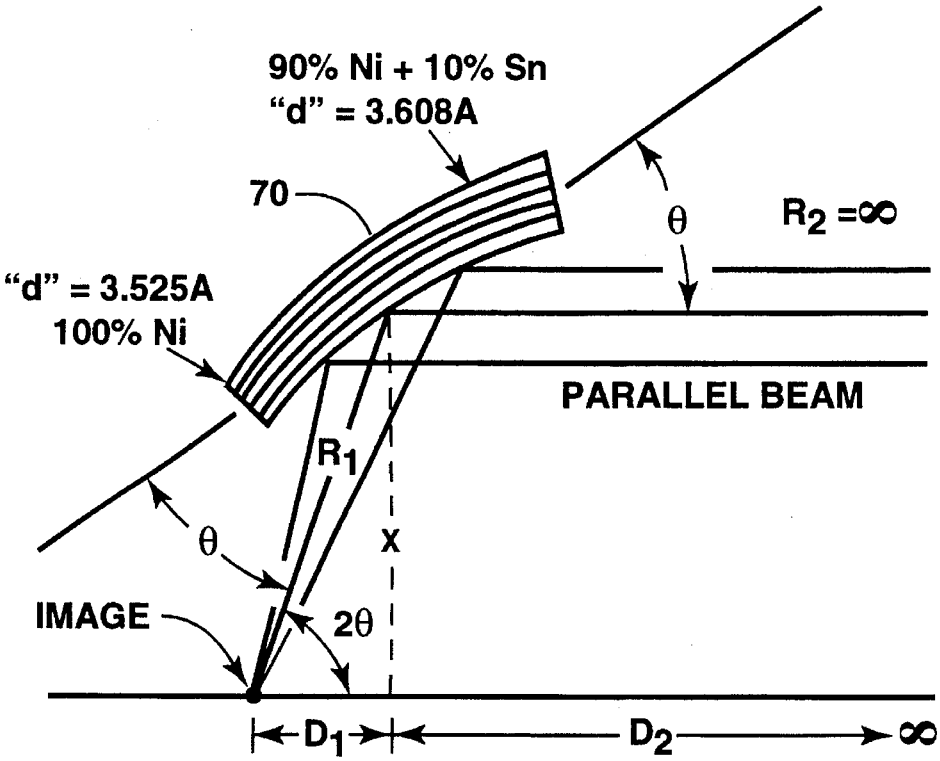
FIG. 7 is a schematic drawing of the V-M lens/crystal element 70 that uses a change in its chemical composition (Ni—Sn) to obtain the change in lattice spacing to collect radiation by reflection technique onto a very small focal point.
Figure 8:
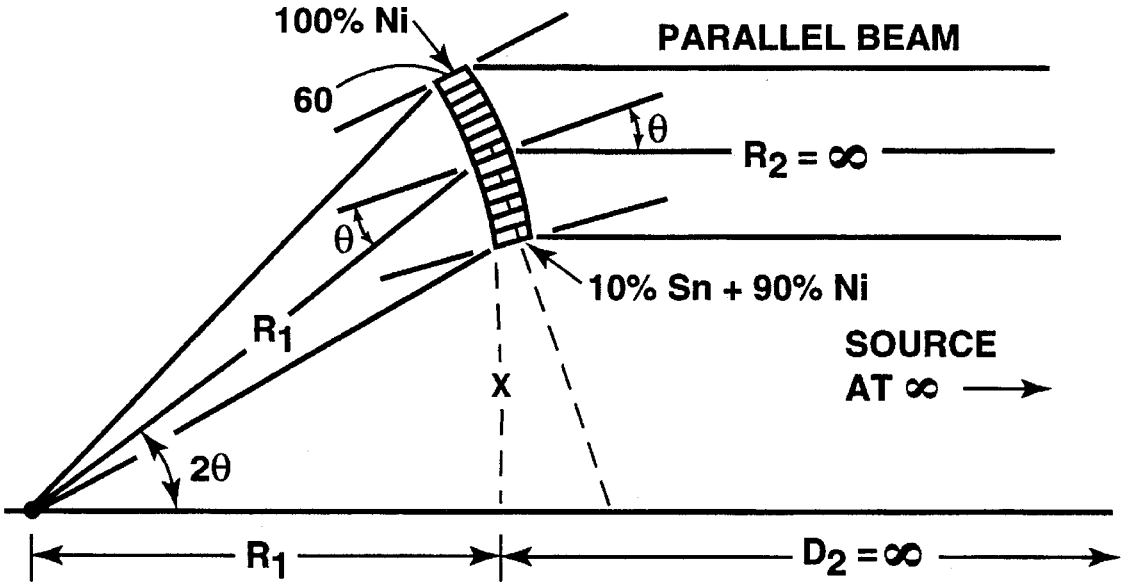
FIG. 8 is a schematic drawing of the V-M lens/crystal element 80 that uses a change in its chemical composition (Ni—Sn) to obtain the change in lattice spacing to collect radiation by transmission technique onto a very small focal point.

The gamma-ray homing sensor/seeker technique of this invention employs a combination of devices which are effective at short distances and longer distances. The method of the system is accomplished at short distances of about 5 to 10 kilometers without the use of any activation methods. At longer ranges of more than 100 Km, an activation method (such as a Neutral Particle Beam Weapon) must be used in conjunction with the gamma seeker discriminator, in order to obtain the gamma signal required by the gamma sensor. The gamma sensor will be aided by a conventional infrared sensor, in order to assure that the interceptor detects the targets at large distances, and to perform the tracking of the target after the gamma seeker discriminator has identified a RV. In other words, the IR sensor will perform the tracking, while the gamma seeker discriminator will perform the discrimination function. The gamma seeker discriminator also provides the interceptor with a means of performing sensor fusion of the gamma signatures with the infrared data on the same interceptor platform to enhance performance.

The key element in this system is a crystal diffraction lens that collects radiation over a large area and focuses it on to a relatively small detector. This system uses "Variable-Metric" (V-M) crystals. A V-M crystal is formed by varying the crystal lattice spacing with position in the crystal, allowing for greater focusing strength and imaging properties, when compared to conventional condensing lenses (flat crystals). The V-M crystals can focus gamma-rays onto detectors of diameters of less than one millimeter, while conventional state-of-the-art flat mirrors are limited to about one square centimeter (see FIGS. 1,2, 3, and 4). As can be seen in FIGS. 5, 6, 7, and 8, the V-M lens is obtained by either creating a thermal gradient across the lens, or by changing the chemical composition of the lens in order to obtain the change in lattice spacing, which results in greater focusing strength.

From a systems point of view, the V-M crystals provide a factor of better than 100 signal gain (i.e. 1 $cm^2$/1 $mm^2$), which also results in a factor of better than 100 improvement in the signal to noise ratio of the sensor, when compared to "conventional" gamma sensors. This allows for adequate gamma detection of an RV at about 10 kilometers with no activation techniques. When used in conjunction with a Neutral Particle Beam (i.e.,activation of the nuclear material), detection at ranges of more than 100 kilometers can be obtained. Additionally, by choosing to look at only a couple of narrow energy band widths, the V-M crystal lens can be designed to limit the sensor to a field-of-view of a few arc seconds which is well within the field of view, required to eliminate off axis nuclear detonations.

We have identified and employed a very promising gamma seeker that discriminates RV's from decoys by measuring the fission gammas emitted by a RV containing a nuclear warhead. This measuring of fission gammas is viable because of a relatively new gamma detection device (identified under reference 1) which has been invented at Argonne National Laboratories by Robert K. Smither (U.S. Pat. No. 4,429,411, entitled "Instrument and Method for Focusing X-rays, Gamma-Rays, and Neutrons" (issued 31 Jan. 1984)). This instrument and method provide orders of magnitude better signal to noise ratio than conventional gamma-ray sensors while also providing better instantaneous field-of-view capabilities. The signal to noise improvement has resulted in improving the sensors detection range from a few kilometers to hundreds of kilometers. As will be discussed in the next few paragraphs, the small instantaneous field of view (a few arc seconds) provides the system with substantial background noise reduction (about two orders of magnitude better than conventional gamma-ray sensors), which is required in the presence of nuclear detonations.

Figure 9:
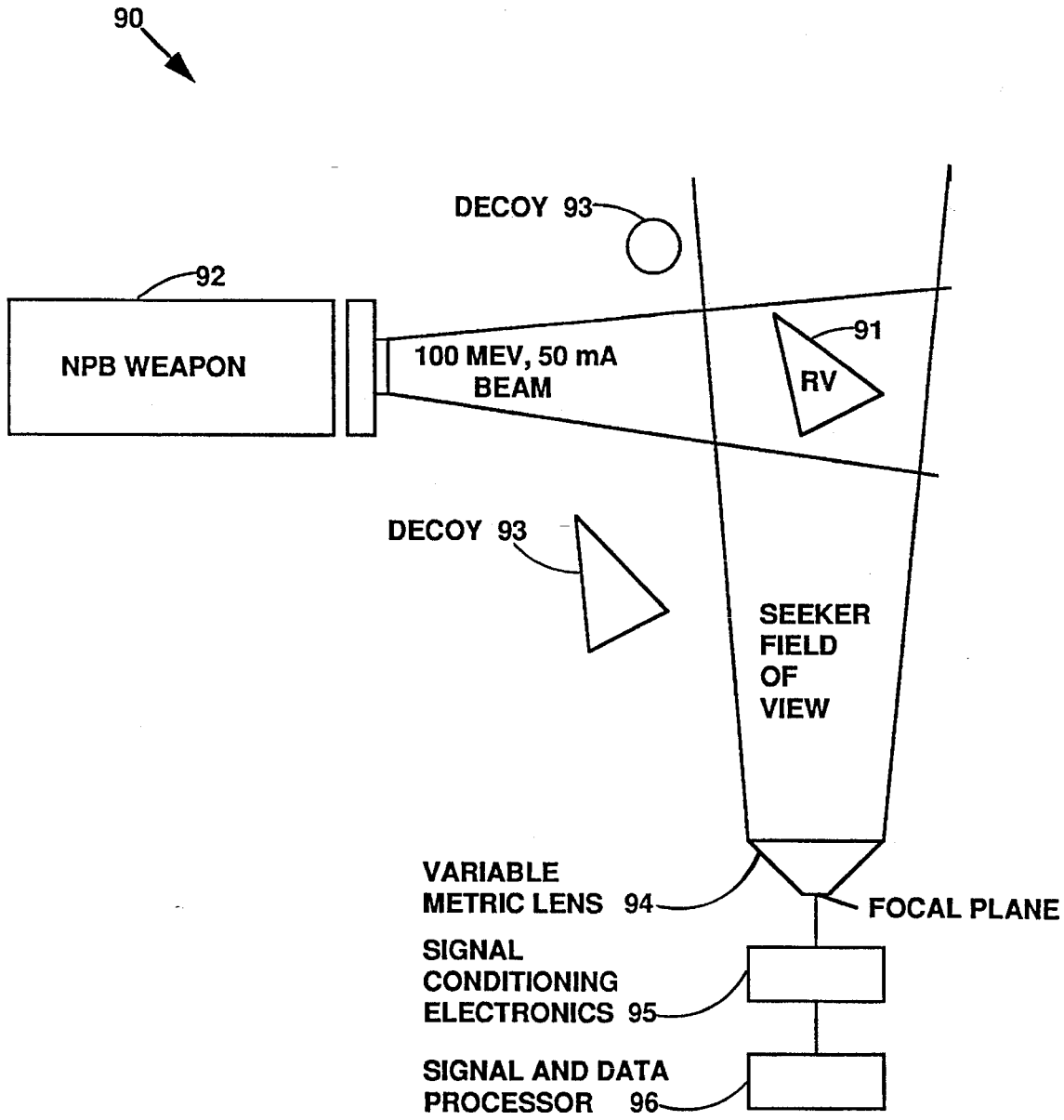
FIG. 9 is an artistic representation of the gamma-ray homing Interactive Discrimination (IR) system 90.

In further reference to the drawings, FIG. 9 is an artistic representation of the gamma-homing Interactive discriminator 90 exclusive of interceptor platform, missile components, and other extraneous structures. A reentry vehicle 91 is also illustrated in FIG. 9 along with decoys 93 in 0.1 milliradian field-of-view which has been focused by a variable metric crystal lens 94. Signal conditioning electronics 95 receives the detector signal and converts the signal to data for further processing by signal and data processor 96. The signal conditioning electronics is responsible for converting the detector signal to a voltage, amplification of the voltage, low pass filtering (to reduce noise), and conversion of the analog voltage to digital via an Analog to Digital (A/D) converter. The electronics needed to perform these signal conditioning tasks do not require development as they already exist in various commercial and defense applications. The signal data processor also consists of Off-the-Shelf technologies that are found in various commercial and defense applications. The main functions of the processor are to (1) set a signal detection threshold by implementation of a discriminator, (2) count only those voltages above the discriminator threshold via a counter, and (3) store the counts received and make a decision whether the target possesses nuclear material or not (i.e., decision electronics). "Optical Sensing Techniques and Signal Processing" by Tudor E. Jenkins (Published by Prentice/Hall International, Englewood Cliffs, N.J., 1987) provides further information on the subject matter of optical sensing and signal processing.

As discussed earlier, the gamma seeker discriminator can be implemented in two ways. The first method is to detect the natural fission of the warhead contained within the RV, the second method is to activate the warhead by using a neutral particle beam weapon 92. Since non activation requires the interceptor to be substantially closer to obtain enough signal, we have chosen to discuss only with the activation method below, as we feel it is the only viable approach. In a preferred embodiment, ground based interceptors (space based interceptors would also be applicable) are equipped with 50 cm diameter V-M crystal lens 94 gamma-ray seeker discriminators (possessing the capabilities described hereinabove), and conventional Infrared sensors to performing the tracking functions. The interceptor will use the IR sensor to acquire the incoming targets at distances larger than 100 Km.

Figure 10B:
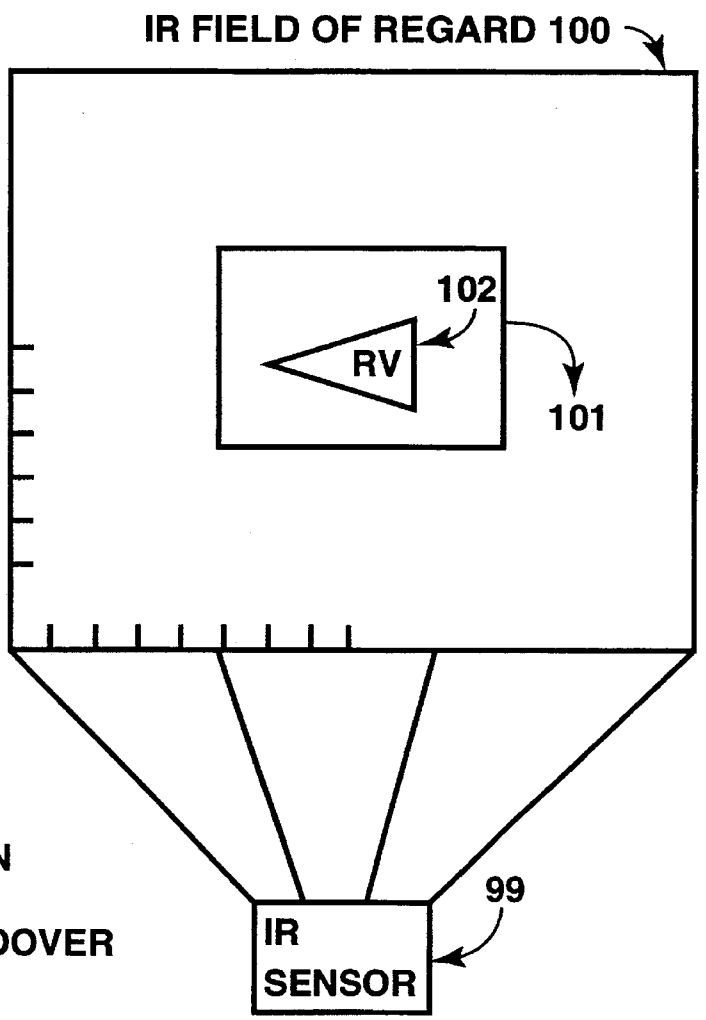
FIG. 10 illustrates IR sensor 99 with field Of regard (FOR) 100 acquiring target 102, gamma seeker's field of view (FOV) 101 scanning IR sensor's FOR 100, gamma seeker's FOV 101 finding object 102 emitting gammas, and the handover by gamma seeker's FOV 101 of the coordinates to IR sensor 99 with FOR 100.
Figure 10A:
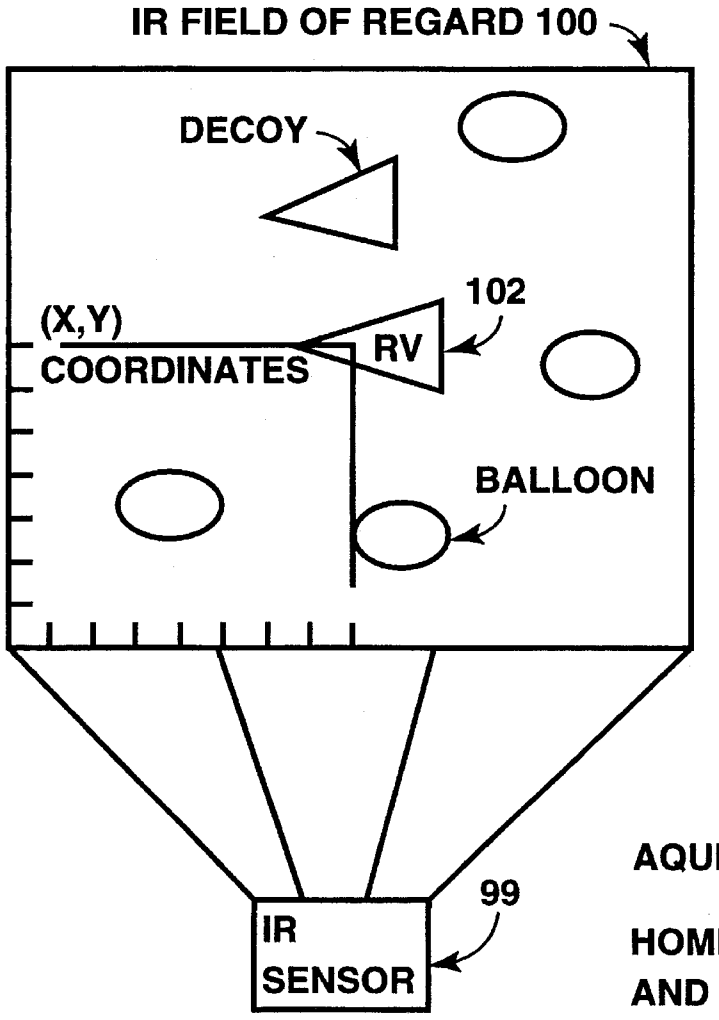

The Neutral Particle Beam (NPB) will irradiate incoming targets in 50 milliseconds intervals before the incoming threat comes into the operating range of the interceptor discriminators. Significantly more gamma emissions result from the irradiation of a RV, than from a decoy or balloon. It follows that interceptors equipped with V-M crystal gamma seeker discriminators will receive a large amount of gamma signal from the RVs, and very little from decoys or balloons. As shown in FIG. 10, at about 100 to 150 Km out, the interceptor will "turn on" the gamma seeker discriminator and scan through the IR sensor's field of view (FOV) to detect the gamma emissions resulting from the NPB irradiation. As illustrated in FIG. 10, the IR sensor's field of regard (FOR) 100 is larger than the gamma seeker's (FOV)101 at target acquisition. The gamma seeker "stares" at each target in the IR sensor's FOR. Upon detection of an object emitting gamma, the gamma seeker relays the target coordinates to the IR sensor. Since the gamma and IR sensors are located on the same platform, the gamma sensor scans the IR (FOR)and correlates the relative coordinates back and forth between sensors. Problems such as closely spaced objects and coordinate handover errors may occur, but these problems exist for any intercepter and are not specific to this embodiment of this invention.

In further regards to the teaching of application techniques, the non-fusion embodiment and the fusion embodiment are two techniques for making an intercept. These embodiments, which are illustrated in the drawing, FIG. 10, will be described in further detail. In the non-fusion embodiment, the gamma sensor hands over the lethal target coordinates to the IR sensor to perform homing and tracking. Updates from the gamma sensor are not relayed to the IR sensor as the intercepter closes in on the target. In the fusion embodiment, the gamma sensor hands over the lethal target coordinates to the IR sensor to perform homing and tracking. Updates from the gamma sensor are relayed periodically to IR sensor to confirm that the gamma counts are increasing as the intercepter approaches the target. If this is not the case, then obviously there has been an error made. This error would not have been identified in the non-fusion embodiment. The interceptor will decide from the signal-to-noise comparisons which object is a true RV. From here, the infrared sensor will be given the handover coordinates and the IR sensor will be used to make the intercept. If need be, the gamma signatures could be "fused together" with the IR information to allow the interceptor to home in on and destroy the RV.

In the specifications hereinbelow, the teachings illustrate and demonstrate that an adequate gamma signal can be obtained by the gamma seeker at a range of more than 100 kilometers when the target has been activated by a NPB. Ranges of about 10 kilometers can be obtained without any activation.

EXAMPLE I

CALCULATION OF SIGNAL COLLECTED BY THE GAMMA SEEKER

Assume a 100 MeV, 50 mA, H° Neutral Particle Beam Weapon system which performs 50 millisecond interrogations of targets at a range of about 200 kilometers. The amount of H° particles produced by the particle beam per interrogation is then: ($50\times10^{-3}$ Amp)(50 msec/pulse)($6.2\times10^{18}$ particles/sec-Amp) which equals $1.55\times10^{16}$ particles/pulse.

The approximate fraction of the amount of H° particles actually hitting the target due to targeting errors, and beam divergence, is assumed to be about 30 percent for the distances assumed. Therefore, approximately $4.65\times10^{15}$ particles/pulse impact the target. The integrated photon yield from a 50 MeV particle beam bombardment of a RV has been determined experimentally to be approximately 0.003 photons/H° sr, with decoy emissions being up to an order of magnitude less. Photon yields for a 100 MeV particle beam bombardment are substantially greater than the 50 MeV case. Therefore, at least ($4.65\times10^{15}$) (0.003)=$1.4\times10^{13}$ photons/sr are emitted by a RV bombarded by a 100 MeV, 50 mA NPB system.

Table 1, set forth hereinbelow, reveals the efficiency for a 4 meter diameter V-M crystal lens gamma detector to 100 KeV photons (which are in the range of interest); operating in the less efficient transmission mode is described hereinbelow at the bottom of Table 1 (which is used for photon energies above 50 KeV).

TABLE 1

Efficiency of 4 meter diameter crystal lens for 100 Kev photons

| Source (Curies) | Distance (Km) | Focal Spot (photons/s) | Efficiency (Id/Is) |
|---|---|---|---|
| 0.001 | 1. | 10. | $2.63\times10^{-7}$ |
| 1. | 1. | 10000. | $2.63\times10^{-7}$ |
| 10. | 10. | 1000. | $2.63\times10^{-9}$ |
| 100. | 100. | 100. | $2.63\times10^{-11}$ |
| 1000.0 | 1000. | 10. | $2.63\times10^{-13}$ |

If a 50 centimeter diameter V-M crystal lens is chosen, instead of the 4 meter sensor described in Table 1, the gamma detection efficiency would decrease by about a factor of sixty-four (i.e.$4^2/0.5^2$) to $4.11\times10^{-13}$ at a distance of 100 Km. Therefore, using this efficiency, the number of photons collected on the focal plane of the 50 cm gamma sensor is estimated to be: ($1.4\times10^{13}$)×($4.11\times10^{-13}$); efficiency=5.8 photons/pulse.

Figure 11:
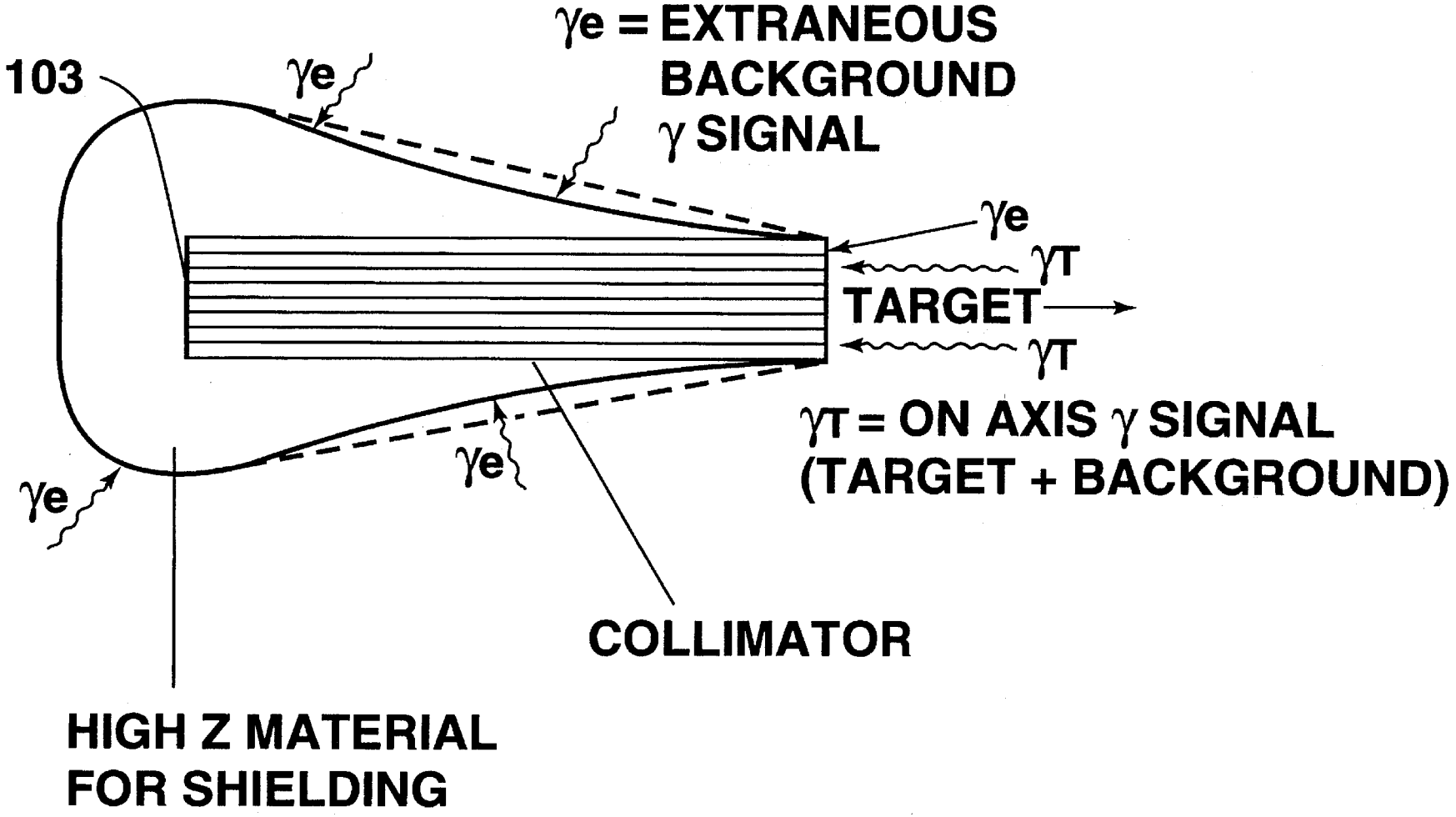
FIG. 11 depicts a narrow field of view gamma sensor 103 shielding of background signals.

The natural background seen by the sensor is reported in references 2 and 4 to be a maximum (looking down at the earth) of $2\times10^{-2}$ photons/sec, which would correspond to $1\times10^{-3}$ photons/pulse. This results in a noise background that is at least 3 orders of magnitude below the signal, which should be more than adequate to insure detection. Once the target is identified by the gamma seeker discriminator as an RV, the information can be handed over to the IR sensor to perform the intercept, or the IR and gamma signatures can be "fused" together to ensure that the intercept occurs. At distances of less than 100 Km, the activation, combined with the closeness of the interceptor will result in thousands of photons/sec on the focal plane of the gamma seeker. If the gamma sensor maintains a 0.1 milliradian field-of-view (optimized V-M crystals can do an order of magnitude better than this), then the gamma sensor will be able to separate between closely spaced objects and greatly eliminate any background environments caused from nuclear detonations, which will allow for accurate identification of a RV. If lead shielding is placed around the detector as shown in FIG. 11, calculations yield a probability of better than 99 percent that no burst would be in the detector field-of-view.

In the case where no activation of the target by a NPB occurs,there is approximately four to five orders of magnitude reduction in the amount of gamma signal escaping the RV. Therefore, assuming the gamma efficiency of the sensor to be 100 times better at 10 Km, and the gammas emitted from the RV to be $5\times10^8$ photons/sec, yields: $(5\times10^8$ photons/sec$)(4.11\times10^{-11})=2\times10^{-2}$ photons/sec which, as discussed above, corresponds to the absolute maximum background that would be expected. However, 10 kilometers is probably too close to perform divert maneuvers, and therefore, has not been pursued any further.

It is concluded that an innovative interceptor seeker discriminator system has been presented which has the capability to home in on targets containing nuclear materials by detecting the gamma fissions. The gamma signatures can be obtained from activating the nuclear material by a Neutral Particle Beam Weapon, or by detecting the natural fission emissions of the warhead. This system is innovative, in that the following properties are identified: 1) This system uses interactive discrimination techniques, which allows the gamma seeker to accurately home in on a true RV by comparing the return gamma emissions of objects. Existing passive IR seeker interceptor technologies do not have this capability. As such, the gamma seeker discriminator is expected to obtain substantially better discrimination K factor performance, when compared to using only IR techniques. 2) To our knowledge, the concept of using an interceptor/seeker to perform interactive discrimination has not been proposed before, as is using gamma sensors in conjunction with infrared sensors on the same interceptor platform (i.e., sensor fusion). A significant enhancement in interceptor performance is expected-by incorporating these methods. 3) This system is ideal for applications involving point defense for Conus Global Positioning Against Limited Strikes (GPALS) threat scenarios, and Nuclear Theater Missile Defense (TMD) threats.

We claim:

1. An interceptor seeker and discriminator using infrared and gamma sensors and having the capability of fusing together gamma signatures with infrared information based on tracking signals to allow the interceptor to home in on and destroy a reentry vehicle target containing a nuclear warhead, said infrared and gamma sensors being effective at short distances of about 5 to 10 kilometers and at long distances of more than 100 kilometers, said shorter distance being accomplished without the use of any activation methods and whereas said longer distances being accomplished with activation in order to provide sufficient gamma signal required by a gamma sensor, said interceptor seeker and discriminator employing infrared and gamma sensors comprising:

(i) an interceptor equipped with a variable metric crystals gamma-ray seeker discriminator and infrared sensors for performing the tracking functions of a reentry vehicle target, said variable metric crystal gamma-ray seeker capable of receiving gamma-rays resulting from fission gammas emitted by a reentry vehicle target containing a nuclear warhead so as to identify a reentry vehicle target among decoys in proximity of said reentry vehicle target;

(ii) an infrared sensor for tracking an identified reentry vehicle target, said infrared sensor provided with a variable metric crystal lens selected from a variable metric crystal lens consisting of variable metric crystals whereby the variation in the crystal lattice spacing is obtained by a thermal gradient and a variable metric crystals whereby the variation in the crystal lattice spacing is obtained by a change in its composition, said infrared sensor performing the tracking function;

(iii) signal conditioning electronics means for processing gamma-rays received from a field-of view of a few arc seconds and focused onto detectors of less than one millimeter by said interceptor; and, (iv) signal and data processing means to provide handover coordinates to an infrared sensor which serves to track a reentry vehicle target and to provide information for said interceptor to intercept of a reentry vehicle target containing a nuclear warhead.

2. The interceptor seeker and discriminator using infrared and gamma sensors as defined in claim 1 and additionally comprising a neutral particle beam source for irradiating a reentry vehicle target associated with decoys or balloons at a longer distance of about 100 to 150 Km whereby after irradiating said reentry vehicle target associated with decoys or balloons the interceptor will turn on said gamma seeker discriminator which scans through the infrared sensor's field of view to detect an amount of gamma emissions resulting from the neutral particle beam irradiation greater than the gamma emissions from said decoys or balloons whereby said interceptor designates the reentry vehicle target and provides handover coordinates of the designated reentry vehicle target to the infrared sensor which provides information for said interceptor to intercept the designated reentry vehicle target.

3. The interceptor seeker and discriminator using infrared and gamma sensors and said neutral particle beam source as defined in claim 2 whereby said gamma signals are fused with the infrared information to allow said interceptor to home in on and destroy the designated reentry vehicle target.

4. An interceptor seeker and discriminator using gamma sensors in conjunction with infrared sensors located on the same interceptor platform to accurately discriminate a reenty vehicle target from decoys in proximity of said reentry vehicle target by detecting gammas emanating as a result of natural fission from a warhead contained within said reentry vehicle target and by detecting gammas emanating as a result of activation of a warhead contained within said reentry vehicle target comprising:

(i) an interceptor equipped with a variable metric crystals gamma-ray seeker discriminator and infrared sensors for performing the tracking functions of a reentry vehicle target;

(ii) an infrared sensor for tracking an identified reentry vehicle target, said infrared sensor provided with a variable metric crystal lens selected from a variable metric crystal lens consisting of variable metric crystals whereby the variation in the crystal lattice spacing is obtained by a thermal gradient and a variable metric crystals whereby the variation in the crystal lattice spacing is obtained by a change in its composition, said infrared sensor performing the tracking function;

(iii) signal conditioning electronics mounted within the focal plane of said variable metric crystal gamma sensor for directing the data received from a small instantaneous 0.1 milliradian field-of view which has been focused by said variable metric crystal lens to a detector of diameters of less than one millimeter; and, (iv) signal and data processor for performing handover coordinates from said infrared sensor to interceptor to make the intercept with a reentry vehicle target.

5. The interceptor seeker and discriminator using gamma sensors in conjunction with infrared sensors as defined in claim 4 wherein said gammas emanating as a result of activation of a warhead contained within said reentry vehicle target is achieved from activation by a neutral particle beam source contained on the same interceptor platform.

6. The interceptor seeker and discriminator using gamma sensors in conjunction with infrared sensors as defined claim 5 wherein gammas signatures and said handover coordinates from said infrared sensor are fused together by said interceptor to achieve interception with a reentry vehicle target.

* * * * *